US009120025B2

(12) United States Patent
Hudson et al.

(10) Patent No.: US 9,120,025 B2
(45) Date of Patent: Sep. 1, 2015

(54) CORE WITH FINGER INDENTATION AND FORMED TO EXPEL AN OBJECT CONCEALED THEREIN

(75) Inventors: Jon Hudson, Woodland Hills, CA (US); Dominic Laurienzo, Los Angeles, CA (US); Jared Wolfson, Calabasas, CA (US); Jeremy Padawer, Pacific Palisades, CA (US); Jim McCafferty, San Clemente, CA (US); Greg Leong, Irvine, CA (US); Steven Douglas DeLacy, Santa Ana, CA (US); Dennis Lee Chi Wai, Hong Kong (CN); Timmy Tsui Ka Tim, Hong Kong (CN)

(73) Assignee: JAKKS Pacific, Inc., Santa Monica, CA (US)

( * ) Notice: Subject to any disclaimer, the term of this patent is extended or adjusted under 35 U.S.C. 154(b) by 258 days.

(21) Appl. No.: 13/179,432

(22) Filed: Jul. 8, 2011

(65) Prior Publication Data

US 2012/0058706 A1 Mar. 8, 2012

Related U.S. Application Data

(60) Provisional application No. 61/363,069, filed on Jul. 9, 2010, provisional application No. 61/421,173, filed on Dec. 8, 2010.

(51) Int. Cl.

| | |
|---|---|
| ***A63H 33/00*** | (2006.01) |
| ***A63H 1/00*** | (2006.01) |
| ***A63H 1/32*** | (2006.01) |

(52) U.S. Cl.

CPC .. *A63H 1/00* (2013.01); *A63H 1/32* (2013.01); *A63H 33/003* (2013.01)

(58) Field of Classification Search

CPC ..... A63B 43/06; A63B 43/00; A63B 19/00; A63B 67/06; A63B 69/408; A63B 69/407; A63B 2069/401; A63B 2208/12; F42B 12/362; F42B 6/04; F42B 12/40; A63F 9/008; A63F 9/02; A63H 33/00; A63H 33/16; A63H 33/22; A63H 13/10; A63H 3/46; A63H 3/48; A63H 5/04; A63H 11/06; A63H 11/08; A63H 3/003; A63H 3/02; A63H 7/00; A63H 1/06; A63H 1/02; A63H 27/04; F41B 7/00

USPC ..... 473/570, 577; 446/487, 4, 308, 311, 446/312, 236, 241; 273/317; 124/16, 26

See application file for complete search history.

(56) References Cited

U.S. PATENT DOCUMENTS 1,609,336 A * 12/1926 Ward ..... 446/262
2,546,896 A * 3/1951 Kassuba ..... 473/596

(Continued)

FOREIGN PATENT DOCUMENTS

EP 0296294 12/1988
FR 2591905 6/1987

(Continued)

OTHER PUBLICATIONS

PCT International Search Report and the Written Opinion of the International Searching Authority for PCT/US2012/056031.

(Continued)

*Primary Examiner* — Michael Dennis
*Assistant Examiner* — Urszula M Cegielnik
(74) *Attorney, Agent, or Firm* — Tope-McKay & Associates

(57) ABSTRACT

A rotatable core is described. The core includes a cylindrically-shaped housing having an indentation area. The indentation area is formed to guide a user where to place their finger for launching, such that by pressing down on the indentation area, the core is forced against a ground surface, which causes it to spin away from the user. Additionally, the core includes a housing with a cavity therein for receiving the object. A release mechanism is attached with the housing. The release mechanism includes a connector for connecting with a corresponding connector on the object and an expelling mechanism for expelling the object. Upon activation of the release mechanism, the connector releases the object and the expelling mechanism forces the object from the housing.

7 Claims, 19 Drawing Sheets

(56) References Cited

U.S. PATENT DOCUMENTS

| | | | | | |
|---|---|---|---|---|---|
| 2,683,603 | A | * | 7/1954 | Gackenbach | 473/596 |
| 2,692,455 | A | * | 10/1954 | Frampton | 446/310 |
| 2,783,046 | A | * | 2/1957 | Lien | 473/596 |
| 2,788,613 | A | * | 4/1957 | Gelfand et al. | 446/429 |
| 3,018,584 | A | | 1/1962 | Passariello | |
| 3,068,851 | A | * | 12/1962 | Geer, Jr. | 124/16 |
| 3,139,697 | A | * | 7/1964 | Mier | 446/4 |
| 3,492,760 | A | * | 2/1970 | Nishitani | 446/130 |
| 3,538,620 | A | * | 11/1970 | Kohner et al. | 446/310 |
| 3,687,452 | A | * | 8/1972 | Thompson | 473/577 |
| 3,949,990 | A | * | 4/1976 | Polonyi | 446/236 |
| 4,059,089 | A | | 11/1977 | Lehman | |
| 4,118,888 | A | * | 10/1978 | Ogawa | 446/92 |
| 4,203,247 | A | * | 5/1980 | Moe et al. | 446/429 |
| 4,319,751 | A | * | 3/1982 | Kurushima et al. | 446/4 |
| 4,455,781 | A | * | 6/1984 | Blumenthal | 446/241 |
| 4,688,783 | A | | 8/1987 | DuBois | |
| 4,737,135 | A | * | 4/1988 | Johnson et al. | 446/430 |
| 4,886,273 | A | * | 12/1989 | Unger | 473/577 |
| 4,946,413 | A | * | 8/1990 | Lehmann et al. | 446/473 |
| 5,122,089 | A | * | 6/1992 | Haran | 446/257 |
| 5,154,657 | A | * | 10/1992 | Wildman et al. | 446/211 |
| 5,169,354 | A | * | 12/1992 | Norton et al. | 446/241 |
| 5,238,440 | A | * | 8/1993 | Morin | 446/241 |
| 5,290,041 | A | * | 3/1994 | Kettelson | 473/596 |
| 5,314,338 | A | * | 5/1994 | Caveza et al. | 446/241 |
| 5,380,231 | A | * | 1/1995 | Brovelli | 446/6 |
| 5,419,706 | A | * | 5/1995 | Levy et al. | 446/129 |
| 5,453,036 | A | | 9/1995 | Wisznia | |
| 5,593,338 | A | | 1/1997 | Itoh et al. | |
| 5,683,284 | A | | 11/1997 | Christen | |
| 5,810,638 | A | * | 9/1998 | Wood | 446/73 |
| 5,916,007 | A | * | 6/1999 | Maxim | 446/130 |
| 5,941,753 | A | * | 8/1999 | Diresta | 446/257 |
| 5,989,092 | A | * | 11/1999 | McGowan et al. | 446/175 |
| 6,086,449 | A | * | 7/2000 | Sharp | 446/4 |
| 6,171,169 | B1 | * | 1/2001 | Saunders | 446/308 |
| 6,312,306 | B1 | | 11/2001 | Kroll | |
| 6,364,734 | B1 | | 4/2002 | Ng | |
| 6,458,008 | B1 | | 10/2002 | Hyneman | |
| 6,485,017 | B1 | | 11/2002 | Ng | |
| 6,530,817 | B1 | * | 3/2003 | Winslow et al. | 446/256 |
| 6,533,638 | B1 | * | 3/2003 | Nelson et al. | 446/139 |
| 6,540,577 | B1 | * | 4/2003 | Nelson et al. | 446/129 |
| 6,548,982 | B1 | | 4/2003 | Papanikolopoulos | |
| 6,592,426 | B2 | * | 7/2003 | Mesch | 446/310 |
| 6,592,427 | B1 | * | 7/2003 | Wilhelm et al. | 446/129 |
| 6,612,895 | B2 | | 9/2003 | Sze | |
| 6,626,729 | B2 | | 9/2003 | Osawa | |
| 6,648,647 | B2 | * | 11/2003 | Wood et al. | 446/241 |
| 6,761,612 | B1 | * | 7/2004 | Pencil et al. | 446/310 |
| 6,860,787 | B1 | * | 3/2005 | Woodhouse | 446/309 |
| 6,988,927 | B2 | * | 1/2006 | Gingold et al. | 446/308 |
| 7,056,185 | B1 | * | 6/2006 | Anagnostou | 446/456 |
| 7,063,589 | B2 | | 6/2006 | Matsukawa et al. | |
| 7,086,109 | B2 | * | 8/2006 | Fisher et al. | 81/492 |
| 7,140,945 | B2 | * | 11/2006 | Dinhofer | 446/378 |
| 7,168,723 | B2 | * | 1/2007 | de Oliveira | 280/240 |
| 7,427,225 | B2 | | 9/2008 | Matsukawa et al. | |
| 7,591,471 | B2 | * | 9/2009 | Walterscheid | 446/309 |
| 7,731,563 | B2 | * | 6/2010 | Saucier | 446/487 |
| 7,785,168 | B2 | * | 8/2010 | Yamada et al. | 446/129 |
| 7,803,033 | B1 | * | 9/2010 | Walterscheid | 446/308 |
| 7,874,892 | B2 | * | 1/2011 | Hippely | 446/429 |
| 7,927,177 | B1 | * | 4/2011 | Walterscheid | 446/308 |
| 8,568,191 | B2 | * | 10/2013 | Rehkemper et al. | 446/259 |
| 2002/0102903 | A1 | | 8/2002 | Coleman et al. | |
| 2002/0164921 | A1 | * | 11/2002 | Wilkinson et al. | 446/308 |
| 2003/0129920 | A1 | | 7/2003 | Sze | |
| 2003/0137268 | A1 | * | 7/2003 | Papanikolopoulos et al. | 318/568.11 |
| 2006/0260594 | A1 | | 11/2006 | Andersen | |
| 2007/0021029 | A1 | | 1/2007 | Weidetz et al. | |
| 2007/0117492 | A1 | * | 5/2007 | Sze et al. | 446/57 |
| 2007/0117494 | A1 | * | 5/2007 | Sheller | 446/309 |
| 2007/0178996 | A1 | * | 8/2007 | Fenn | 473/578 |
| 2007/0205554 | A1 | | 9/2007 | Elliott | |
| 2008/0277374 | A1 | * | 11/2008 | Miura | 215/384 |
| 2010/0255752 | A1 | | 10/2010 | McCafferty | |

FOREIGN PATENT DOCUMENTS

| | | |
|---|---|---|
| GB | 436912 | 10/1935 |
| WO | 02/24417 | 3/2002 |
| WO | 2006/133069 | 12/2006 |

OTHER PUBLICATIONS

PCT International Search Report and the Written Opinion of the International Searching Authority for PCT/US2012/065702.

PCT International Preliminary Report on Patentability for PCT/US2011/001202.

PCT International Preliminary Report on Patentability from PCT/US2012/065702, mailed on May 30, 2014.

* cited by examiner

604

CORE WITH FINGER INDENTATION AND FORMED TO EXPEL AN OBJECT CONCEALED THEREIN

PRIORITY CLAIM

This is a Non-Provisional Patent Application of U.S. Provisional Application No. 61/363,069, filed on Jul. 9, 2010, and entitled, "Shell for expelling an object concealed therein." This is ALSO a Non-Provisional Patent Application of U.S. Provisional Application No. 61/421,173, filed on Dec. 8, 2010, entitled, "Shell with Finger Indentation."

BACKGROUND OF THE INVENTION (1) Field of Invention

The present invention relates to a rotating item and, more particularly, to an core with a finger indentation to guide a user where to position the user's finger tip to launch the elongated core, with the core having an impact release trigger that expels an object concealed therein upon impact.

(2) Description of Related Art

Spinning tops have long been known in the art. A traditional spinning top is formed with a bulbous top and a single point upon which the top spins. Such tops are typically spun by pulling a string or other item that causes the top to rotate at a high rate of rotation, thereby providing the top with the traditional "spin."

Alternatively, U.S. Pat. No. 3,018,584 (the '584 patent) describes a pinch-spin top, which is spun through the use of a pinching device. The top itself includes a ridge that runs around the circumference of the top. The pinching device can be positioned within the ridge and squeezed to shoot the top from the device, thereby causing the pinch-spin top to spin.

Another variation of the traditional top can be found in U.S. Pat. No. 5,122,089 (the '089 patent), which describes a spin top that includes a cylindrical body of substantially rotational symmetry around a longitudinal axis, with a pointed end face along the axis. The '089 patent describes a foot board (i.e., pinching device) that rests against the cylindrical body and that can be stomped upon to pinch the body from the foot board, causing the top to spin.

Thus, while both the '089 patent and the '584 patent teach a form of a pinch-spin top, they both rely upon a pinching device. Further, each of the cited references do not allow a user to easily spin the top unassisted, as they do not provide for finger markings to guide a user where to position the user's finger tip to launch the top.

In a separate field, toy projectiles have long been known in the art. Toy projectiles typically come in the form of toy guns that are formed to shoot an object from the gun. The toy guns typically include a finger trigger that, upon depression, causes a spring-loaded (or pneumatically powered) mechanism to expel the projectile from the toy gun.

While operable for manually shooting objects, such toy guns do not include impact triggers. Further, the projectiles themselves do not expel any further objects upon impact with another object.

Thus, a continuing need exists for a spinning top or shell with a finger indentation that enables a user to easily spin the shell by guiding the user where to position the user's finger tip during rotation of the shell, with the shell having an with an impact release trigger that expels an object concealed therein upon impact with another object or surface.

SUMMARY OF INVENTION

While considering the failure of others to make use of all of the above components in this technology space, the inventors unexpectedly realized that a core with a finger indention would assist the user to best rotate the core, with the core having an impact release trigger that expels an object concealed therein upon impact would provide for a projectile core capable of expelling another object.

Thus, the present invention is directed to a rotatable core/shell. The core includes a cylindrically-shaped housing without substantially rounded ends, the housing having an external portion. An indentation area is formed in the external portion. The indentation area is formed to guide a user where to place their finger for launching, such that by pressing down on the indentation area, the core is forced against a ground surface, which causes it to spin away from the user. Additionally, the core includes a housing with a cavity therein for receiving the object. A release mechanism is attached with the housing. The release mechanism includes a connector for connecting with a corresponding connector on the object and an expelling mechanism for expelling the object. Upon activation of the release mechanism, the connector releases the object and the expelling mechanism forces the object from the housing.

In, another aspect, the release mechanism is a release trigger and the expelling mechanism is a spring-compressed platform.

In yet another aspect, the release mechanism further comprises a weighted pendulum that is operably connected with the release trigger, such that upon motion of the pendulum, the release trigger releases the object.

Additionally, two raised rings can be provided around a circumference of the core to decrease surface contact of the core while spinning to prolong the spinning properties of the core.

In another aspect, an expandable object with a clasp is included for positioning within the cavity of the housing. The expandable object includes at least one appendage and a collapsed state and an expanded state, such that when the expandable object is within the cavity, the at least one appendage is positioned in the collapsed state and, upon expulsion from the cavity, the at least one appendage is moved into the expanded state.

In another aspect, the connector of the release mechanism is a pair of clips and the release mechanism further comprises an impact trigger that is operably connected with the pair of clips such that upon impact, the impact trigger causes the pair of clips to release the object.

In yet another aspect, the release mechanism includes a pendulum, with the connector being a magnet attached with the pendulum for magnetically connecting with an object positioned within the cavity, such that upon impact of the core with a surface, the pendulum is swung away from the object to break the magnetic connection with the object and release the object from the housing. In this aspect, the expandable object is magnetically attracted to the pendulum with the magnet.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
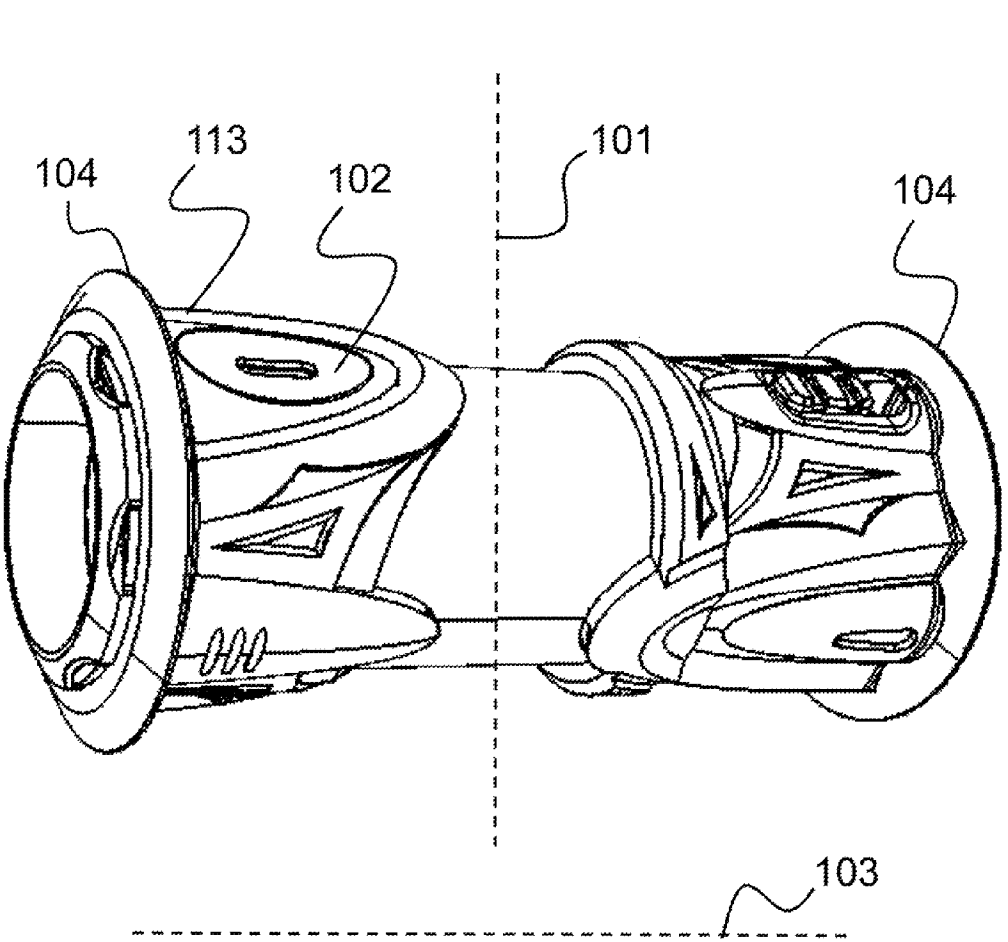
FIG. 1 is an illustration a core according to the present invention.

The present invention relates to a rotating item and, more particularly, to an elongated core with a finger indentation to guide a user where to position the user's finger tip to launch the elongated core, with the core having an impact release trigger that expels an object concealed therein upon impact. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a toy projectile shell (or core) that can be rotated. While the core can be made solid, in one aspect, the core is hollowed out (to include the cavity) and acts like a shell to allow another objet to be positioned or housed therein. The core includes a release mechanism that, when actuated, expels the object concealed therein. Thus, it should be noted that the terms "core" and "shell" can be used interchangeably herein as they are both directed to the basic spinning toy of the present invention.

FIG. 1 depicts an example of the core 100. As shown in FIG. 1, in one aspect, the core 100 is generally cylindrically-shaped without substantially rounded ends. This shape allows the present invention to be spun about the vertical axis 101 while in a horizontal orientation 103, whereas a traditional top rotates in a vertical orientation about the vertical axis 101.

It should be understood that although the core 100 is described as being generally cylindrically-shaped, the present invention is not intended to be limited thereto as it can be formed in any other shape to allow such rotational operations as described herein.

Importantly, each core has a concaved indention area 102 that is specifically design to place a fingertip on. The indentation area 102 can be formed with concavity, or by angling two or more planes together to create an indentation. The indention area 102 is intended to guide the user where to place their finger for launching. Although FIG. 1 depicts a single indentation area 102, it should be understood that the core 100 can include multiple indentation areas 102, such as on opposing ends or sides of the core 100.

The indentation area 102 is formed on an external portion 113 of the core 100 and, desirably, is formed off-center to assist the core 110 in spinning about the vertical axis 101.

In addition to the indentation area 102, the core 100 can be formed to include raised rings 104. The raised rings 104 are formed as circumferentially extending protrusions (such as a ring shape) that extend around the circumference on both ends of the core 100.

Figure 2:
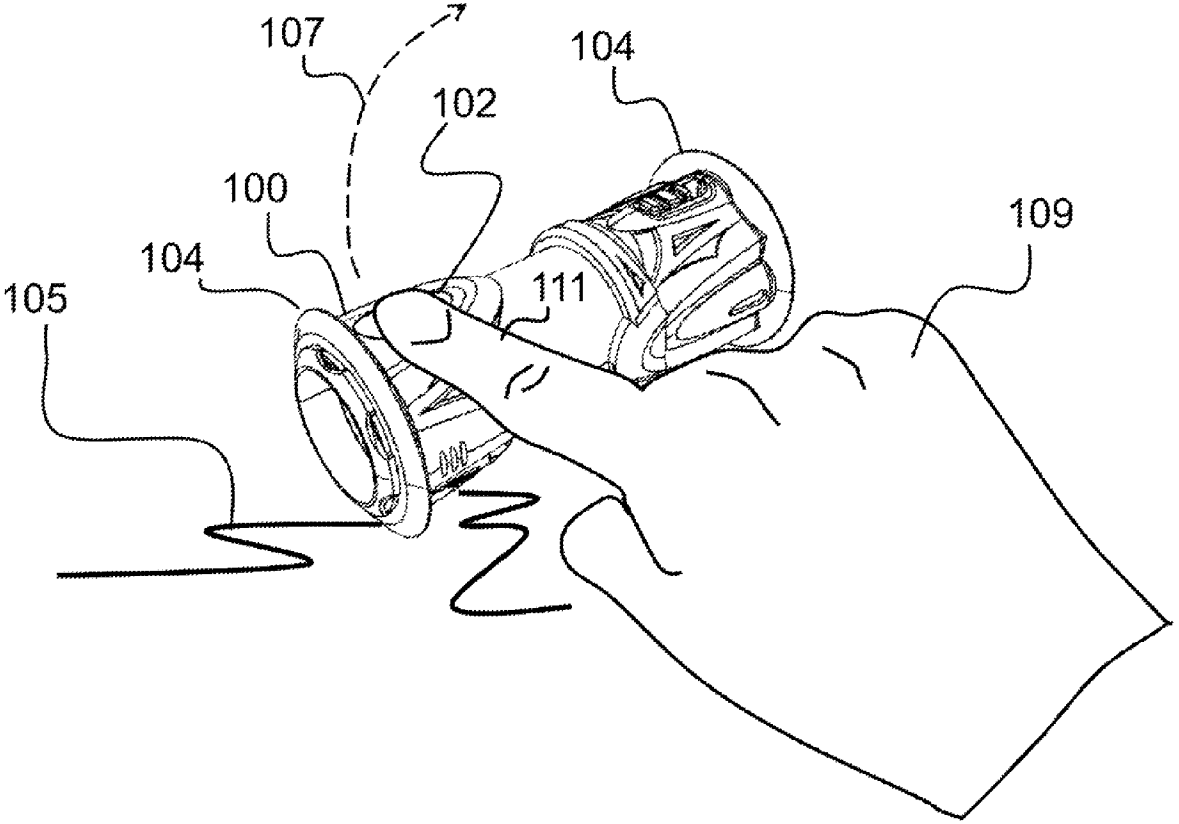
FIG. 2 is an illustration of a core according to the present invention, depicting the core as being positioned and spun upon a surface.

As shown in FIG. 2, by pressing down on the indentation area 102, the core 100 is forced against a ground surface 105, which causes the core 100 to spin 107 away from the user 109. As such, the core 100 can be launched by placing a finger 111 on top of a horizontal core 100 and pressing down in an abrupt motion. The more off-center the finger 111 placement, the more spin 107 can be achieved. Thus, the indentation area 102 is formed at a suitable location on the core 100 to assist the user 109 in achieving a greater spin. For example, the indentation area 102 can be formed on both ends of the core, on opposing sides of the core 100, or on one side (e.g., side of core with an opening; the opening being where the object can be positioned within and expelled from the core).

As mentioned above, the core 100 includes raised rings 104 that wrap around the circumference of the core 100 at its ends to reduce surface contact, thereby extending spins. Thus, as a user 109 positions a fingertip 111 in the indentation area 102 and presses down to force the core 100 against a ground surface 105, the core 100 is forced away from the user 109 in a spin 107. Due to the raised rings 104, the core 100 is capable of spinning for an extended period of time.

As an alternative to positioning the core 100 upon a ground surface 105, the core 100 can also be launched by placing it between the thumb and middle finger and spun with a snapping motion (or a pinching motion). In yet another aspect, a mechanical pinching launcher (e.g., multi-shot) can be used to pinch the core 100 which causes it to spin away from the user.

In another aspect, the core 100 can include an illuminated image that is revealed only when the core 100 is spinning. This can be accomplished through a motion switch or a centrifugal force switch, which activates a light (e.g., LED) that illuminates some shape or image formed along a length of the core 100.

Figure 3:
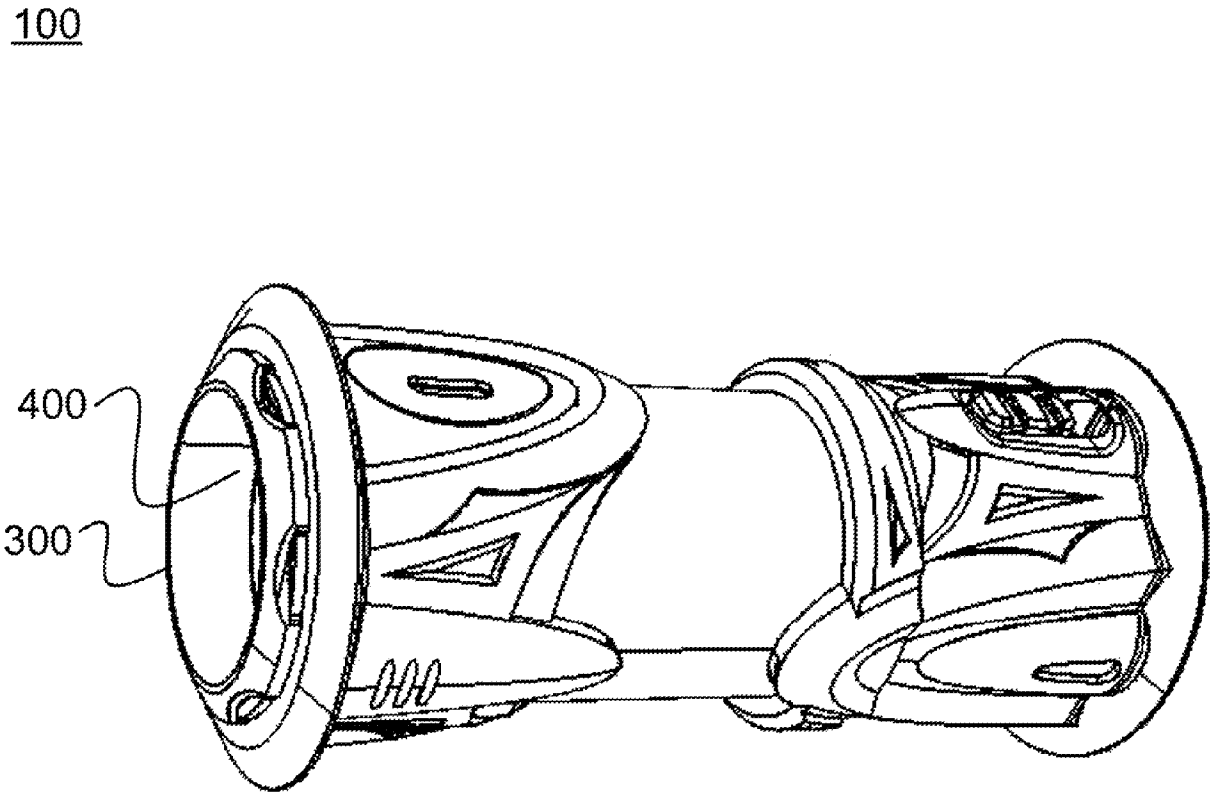
FIG. 3 is an illustration of a core according to the present invention.

As noted above, the core 100 can be used to conceal and expel an object concealed therein. Thus, the core 100, in addition to being a rotatable object (i.e., spinning toy), can operate as a toy projectile shell. In this aspect and as depicted in FIG. 3, the core 100 includes a cavity 400 therein and operates as a housing to house an object. The core 100 also includes a release mechanism that, when actuated, expels the object concealed therein.

As noted above, the core 100 can be formed in a variety of shapes, a non-limiting example of which includes a cylindrically-shaped housing with an opening 300 on one end that provides access to the cavity 400. The core 100 serves two general purposes: (1) to spin on a surface (as describe above) and (2) to house and expel a transforming object (e.g., a transforming monster figure as described in further detail below). In order to expel an object the core 100 includes a release mechanism that, when activated, expels the object from the core 100.

The object is expelled using any suitable release mechanism that can connect with an object and expel the object. The release mechanism can be further enhanced to maintain stored energy and release that stored energy upon activation to expel the object. Thus, in its most basic form, the release mechanism includes a connector for connecting with a corresponding connector on the object.

It should be understood that although three different release mechanisms are illustrated, the present invention is not intended to be limited thereto as it can be conceivably devised using any suitable release mechanism. For example, FIGS. 4A through 5D depict a pendulum actuated trigger release system. As shown in the cross-sectional views of FIGS. 4A and 4B, the core 100 includes a cavity 400 therein for housing the object. The design includes a release trigger 402 that allows the object to be released. In this aspect, a pendulum 404 with a weight 406 is included. The pendulum 404 can swing about within the core 100 and is used to hold the release trigger 402 in a locking position and, thereby, hold the object within the cavity 400. The pendulum 404 has multi-directional movement, such as the ability to swivel about 360 degrees or any suitable range of motion. The weight 406 is any mechanism for adding weight to an end of the pendulum 404, a non-limiting example of which includes a metallic piece (e.g., ring) that is attached with or wrapped around the pendulum 404, such as a die-cast Zine alloy.

Also depicted is a master lock 408. The master lock 408 is any suitable locking mechanism or device that allows a user to fix the object within the cavity 400 of the core 100. As a non-limiting example, the master lock 408 is a slide switch that prevents the release trigger 402 from unlatching from an attached object.

Figure 4A:
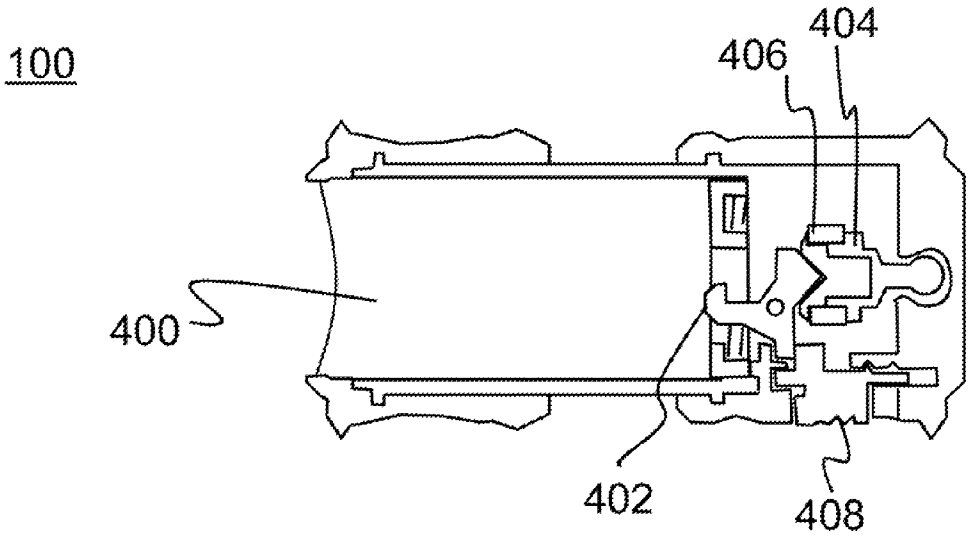
FIG. 4A is a cross-sectional view illustration of a core according to the present invention.
Figure 4B:
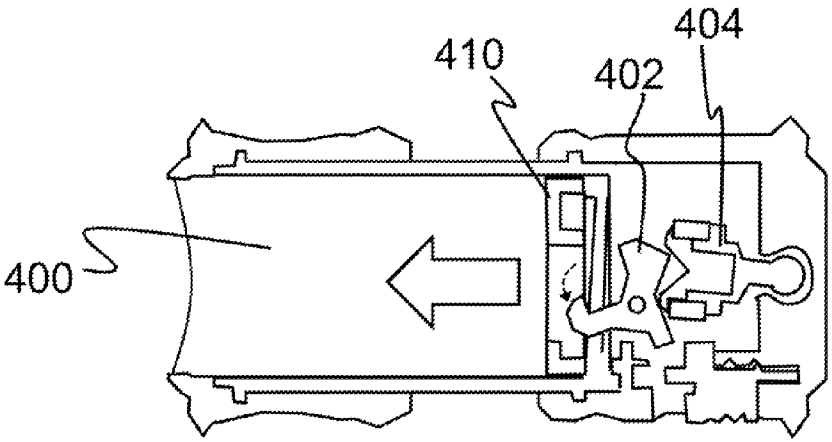
FIG. 4B is a cross-sectional view illustration of a core according to the present invention.

As shown in FIG. 4B, when the pendulum 404 releases the release trigger 402, the object is released from the core 100. If the core 100 is spinning, the object is expelled from the core due to centrifugal force. To assist the expulsion, an expelling mechanism can be included. The expelling mechanism is any suitable mechanism or device for expelling an object, a non-limiting example of which includes a spring-compressed platform 410. The spring-compressed platform 410 can be compressed by the object when the object is affixed within the cavity 400 and used to push the object from the cavity 400 upon release. Thus, the spring-compressed platform 410 is a platform (e.g., plastic platform) with, a spring attached thereto that can be compressed and, upon release, forces the platform outward.

Figure 5A:
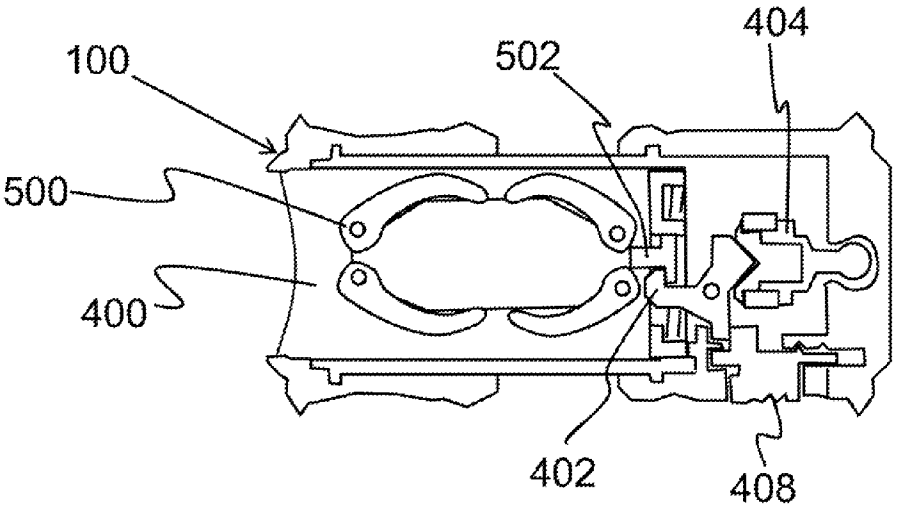
FIG. 5A is a cross-sectional view illustration of a core according to the present invention.
Figure 5B:
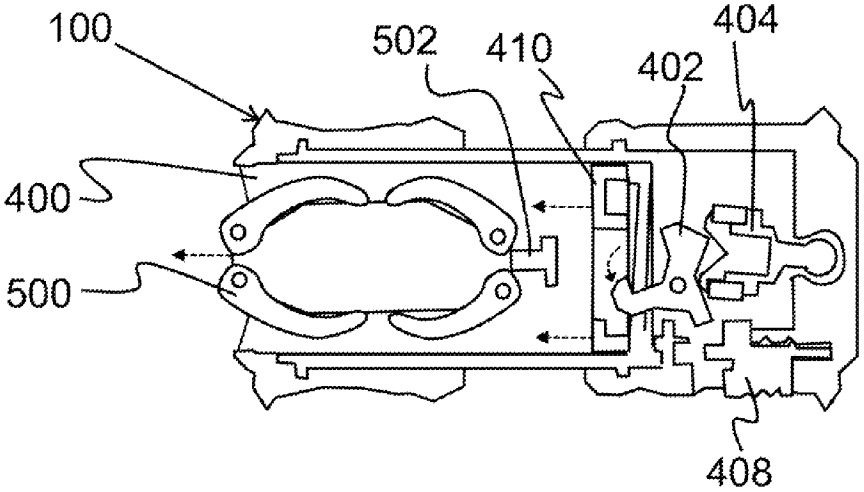
FIG. 5B is a cross-sectional view illustration of a core according to the present invention.

For further understanding, FIGS. 5A and 5B illustrate an object 500 as concealed within the core 100. The object 500 can be a simple projectile type item or an expandable object that transforms into a creature or other item upon expulsion from the core 100.

As shown in FIG. 5A, the release trigger 402 is latched onto a clasp 502 on the object 500, thereby holding the object 500 within the cavity 400. The pendulum 404 is connected to the release trigger 402 using any suitable technique, a non-limiting example of which includes using a v-shaped tongue and groove joint. Also illustrated is the lock mechanism 408 that is positioned to prevent the release trigger 402 from pivoting away from the clasp 502.

Alternatively, FIG. 5B illustrates the lock mechanism 408 in an unlocked position that would allow the release trigger 402 to pivot away from the clasp 502. In operation, a user spins the core 100 upon a surface and, ideally, into another object. Upon impact with another object, the shock of the impact causes the pendulum 404 to swing about and cause the release trigger 402 to unlatch from the clasp 502. When the release trigger 402 is unlatched from the clasp 502, the spring-compressed platform 410 is forced outward (via both centrifugal and spring expansion forces) to force the object 500 from the cavity 400 of the core 100.

Figure 5C:
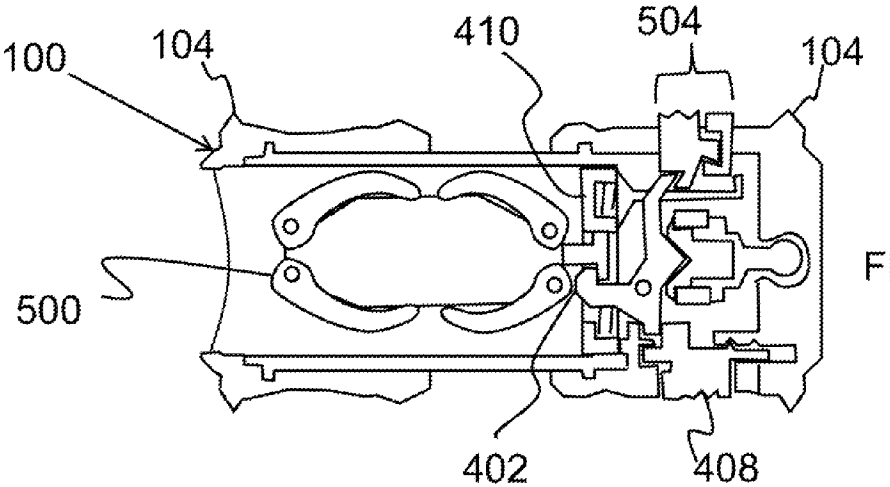
FIG. 5C is across-sectional view illustration of a core according to the present invention.

In another aspect and as shown in FIG. 5C, the core 100 can also be formed to include a manual release switch 504 that allows a user to manually push or release the object 500 from the core 100. For example, the manual release switch 504 can be pushed in and up to release the object 500 from the release trigger 402. When the manual release switch 504 is used, the release spring (such as the spring-compressed platform 410) does not activate, meaning that the object 500 does not shoot out of the core 100. Instead, the object 500 is unlatched from the release trigger 402 so that the user can grab the object and pull it out of the core 100.

Figure 5D:
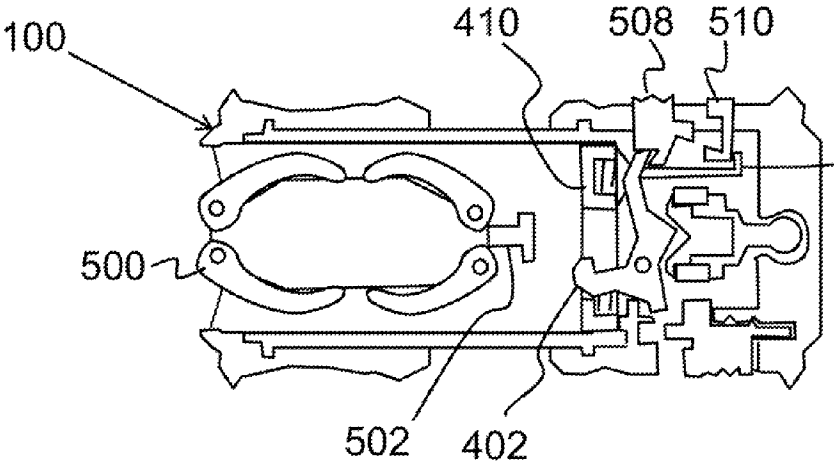
FIG. 5D is a cross-sectional view illustration of a core according to the present invention.

As shown in FIG. 5D, the manual release switch can include two components; a slide switch 508 and a platform catch 510. Pressed in, the platform catch 510 latches with a corresponding catch 512 attached to the spring-compressed platform 410, thereby preventing the spring-compressed platform 410 from releasing. Additionally, the slide switch 508 is formed to tip the trigger release 402 and cause the trigger release 402 to release the clasp 502 of the object 500.

As noted above, the core can include various switches, such as a master lock mechanism and a release switch. Generally speaking, the lock mechanism locks the object within the shell, while the release switch allows the object to be removed from the core without activating the expelling mechanism. For accessibility, the switches may be formed to protrude from the outer surface of the core. However, as illustrated in FIG. 5C, the core 100 can be formed such that it includes a raised rings 104 that extend from the core 100 such that they protrude further than any switches (such as the lock mechanism 408 and/or the release switch 504). Thus, while the core 100 is being spun upon a surface, the raised rings 104 contact the surface while preventing the switches from contacting the surface and interfering with any spin.

Figure 6:
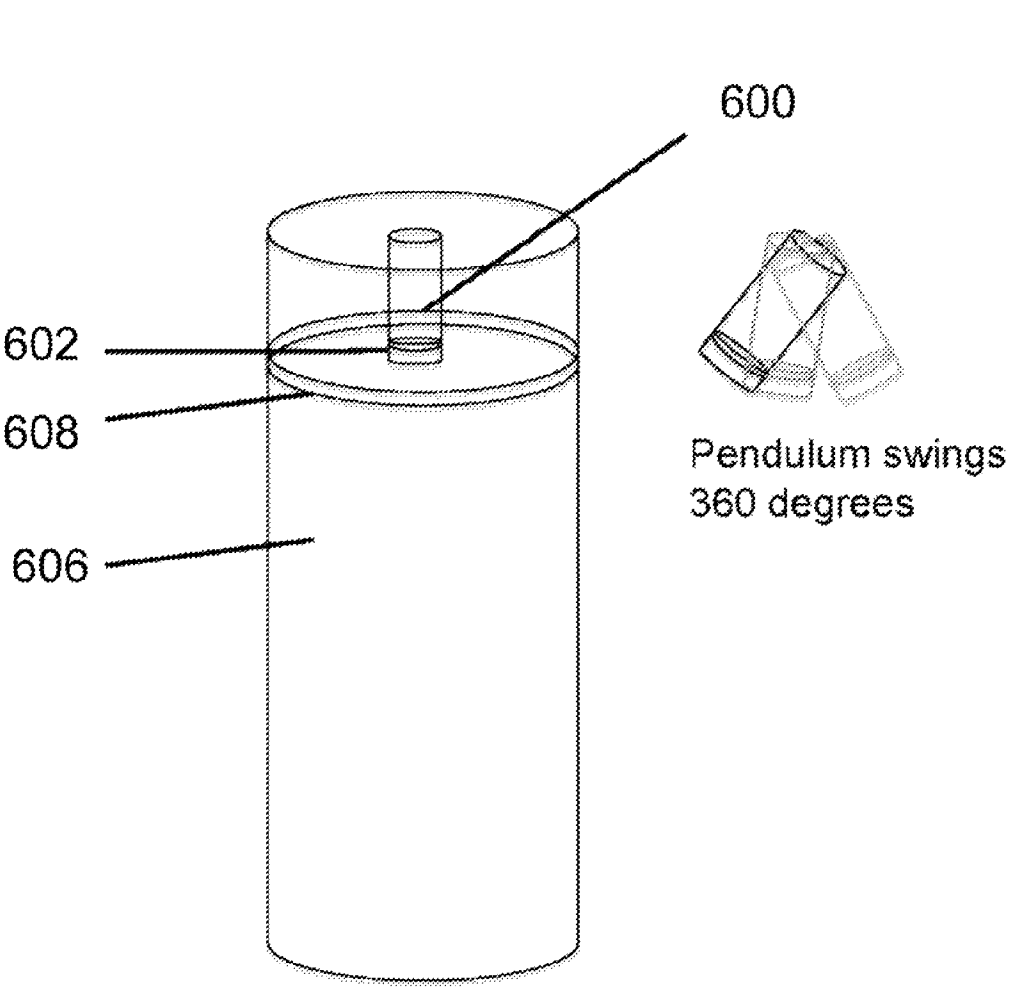
FIG. 6 is an illustration of a core according to the present invention.

Another example of a release mechanism is depicted in FIG. 6. The example as depicted in FIG. 6 includes a pendulum 600 having a magnet 602. The core 604 in this example includes a cavity 606 with a separation wall 608 that separates the cavity 606 from the pendulum 600. To be contrasted with the example above which uses a clasp, the object in this case has a metal component or is otherwise made out of metal. When the object is inserted into the cavity 606 of the core 604, the object becomes locked therein due to the core's magnetic pendulum 600 (i.e., the magnet 602 at the tip of the pendulum 600). When the core 604 is spun and impacts another item or otherwise experiences a shock, the pendulum 600 swings, releasing the magnetic connection between the pendulum 600 and the object. This allows the object to be expelled from the cavity 606 by centrifugal force.

Figure 7A:
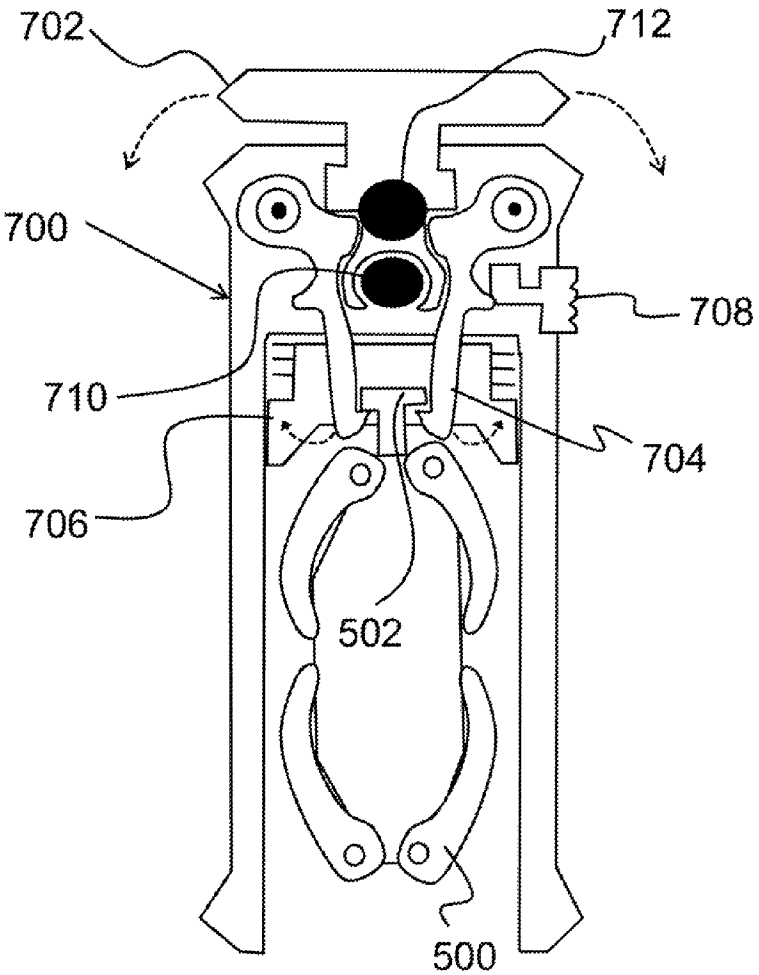
FIG. 7A is a cross-sectional view illustration of a core according to the present invention.

Yet another example of a release mechanism is depicted in FIG. 7A. In this aspect, the core 700 includes joystick impact trigger 702 and a pair of clips 704 that latch onto the object 500 clasp 502. This aspect also includes a spring-compressed platform 706 that acts as a spring-loaded ejection plate. The joystick impact trigger 702 has multi-directional movement that, when impacted with enough force, causes the pair of clips 704 to open and release the clasp 502. More specifically, the joystick impact trigger 702 acts like a lever to force the pair of clips 704 open when being impacted with enough force. When the pair of clips 702 opens, the spring-compressed platform 706 forces the object 500 from the core 700.

This aspect also includes a lock mechanism 708, an object release button 710, and a centrifugal lock 712. The lock mechanism 708 is a slide switch or any other suitable device that can be formed and used to prevent the pair of clips 704 from opening and releasing the clasp 502. Thus, in this aspect, the lock mechanism 708 can be slid and locked against the pair of clips 702 to prevent them from opening.

The object release button 710 is formed such that when depressed, it forces the pair of clips 704 open to release the clasp 502. Finally, the centrifugal lock 712 is a metal ball that is displaced to the side from the center position under centrifugal force while the core 700 is spinning to unlock the joystick impact trigger 702. When the ball is in the original position, the joystick impact trigger 702 is locked. However, when the core 700 is spinning and the ball is not in the original position, the joystick impact trigger 702 is unlocked and can be activated.

Figure 7B:
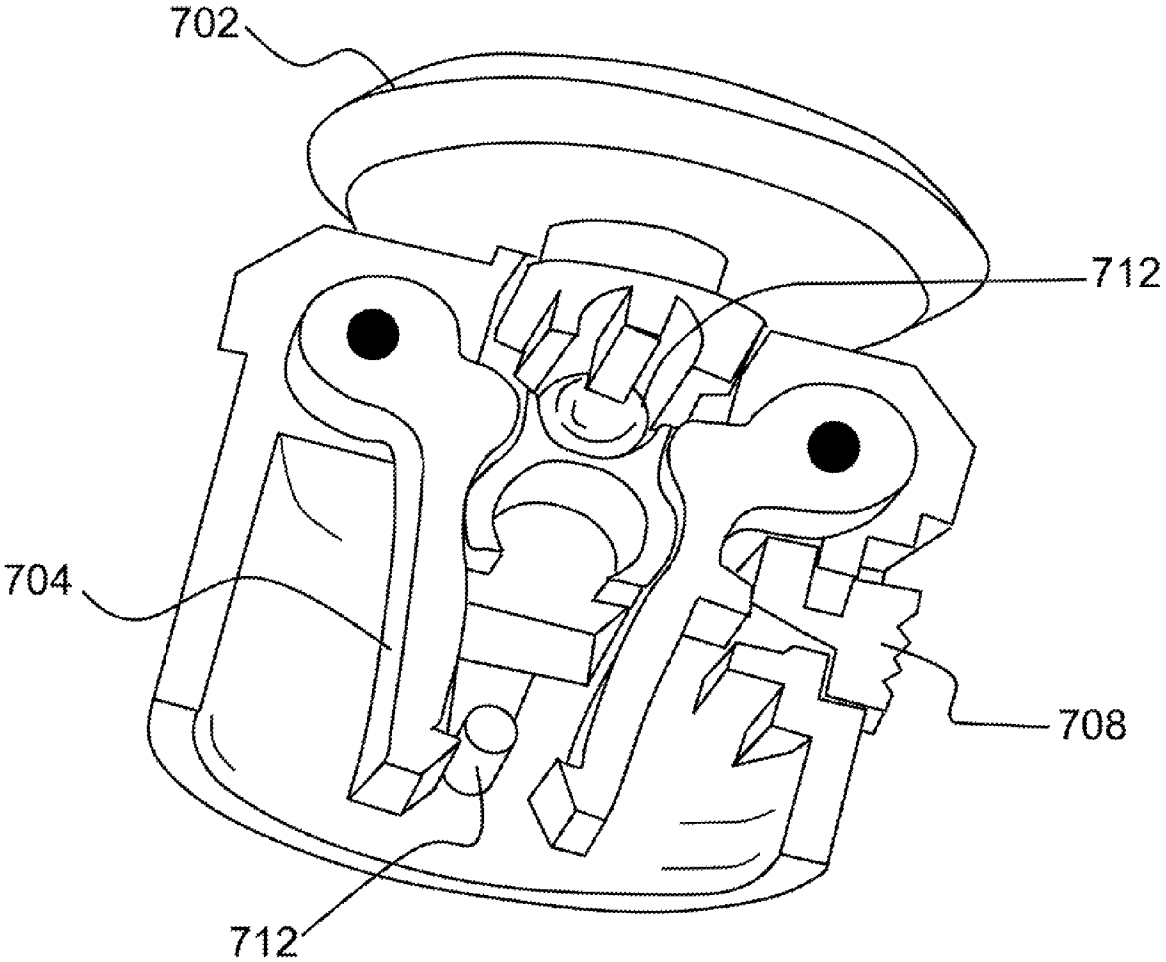
FIG. 7B is a front-side, interior view of the release mechanism depicted in FIG. 7A.
Figure 7C:
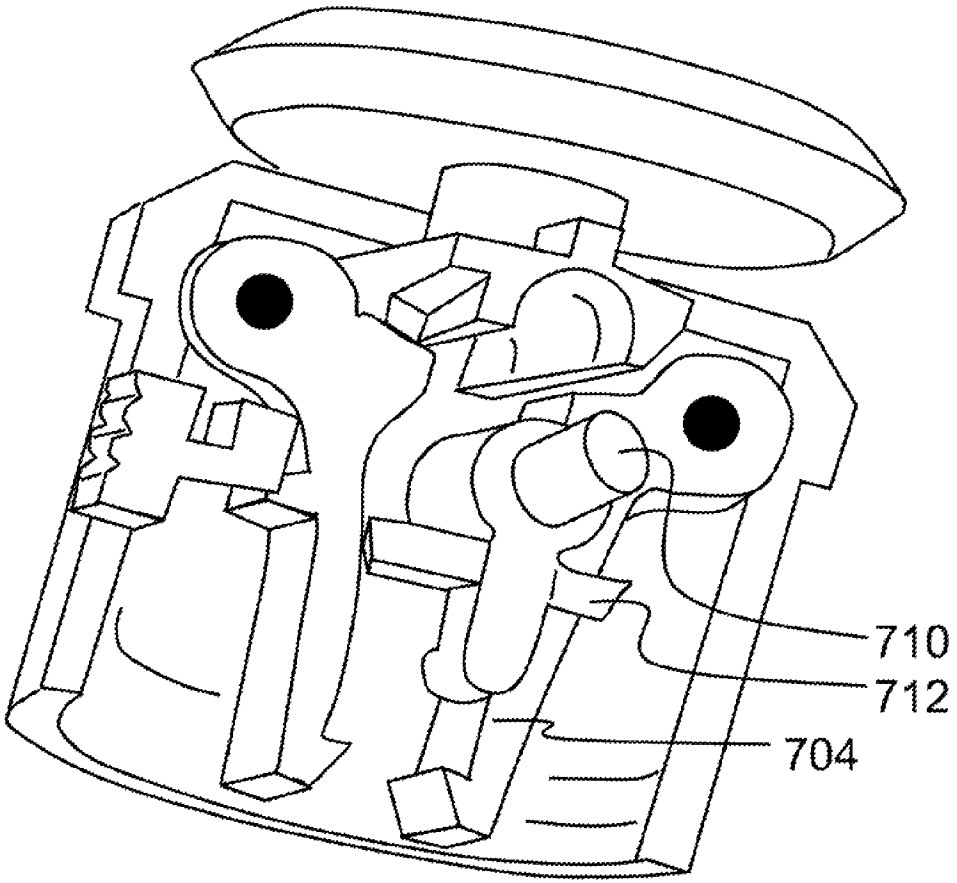
FIG. 7C is a rear-side, interior view of the release mechanism depicted in FIG. 7A.

For further understanding, FIG. 7B provides a front-side, interior view of the release mechanism depicted in FIG. 7A, while FIG. 7C depicts is a rear-side, interior view of the release mechanism depicted in FIG. 7A. As shown in FIG. 7B, the centrifugal lock 712 is a metal ball that is displaced to the side from the center position under centrifugal force while the core is spinning to unlock the joystick impact trigger 702. Upon impact, the joystick impact trigger 702 rotates to force the pair of clips 704 open and release the clasp of the object. Also depicted is the lock mechanism 708 that is used to maintain the object within the core. The lock mechanism 708 is formed to override both the joystick impact trigger 702 and the object release button. Alternatively, if the object release button is used, it wedges open the pair of clips 704 while holding the spring-compressed platform. The object release button includes a protrusion 712 or similar mechanism to engage with a corresponding recess or protrusion in the spring-compressed platform to prevent the spring-compressed platform from activating.

In the rear-side, interior view as shown in FIG. 7C, the object release button 710 is depicted. The object release button 710 is formed such that depressing it causes wings 712 (or any other suitable mechanism or device) to engage with the pair of clips 704 and force the pair of clips 704 apart.

As described herein, a unique aspect of the present invention is its ability to expel an object that is concealed within a cavity of the core. As noted above, the object is any suitable item that can be expelled from the core. As a non-limiting example, the object can be a simple projectile type item that does not change its form (such as a car, rocket, etc.) or, alternatively, an expandable object that transforms into a creature or other item upon expulsion from the core. For further understanding, FIGS. 8A through 10C illustrate three expandable objects in a closed, expanding, and open position, respectively.

Figure 8A:
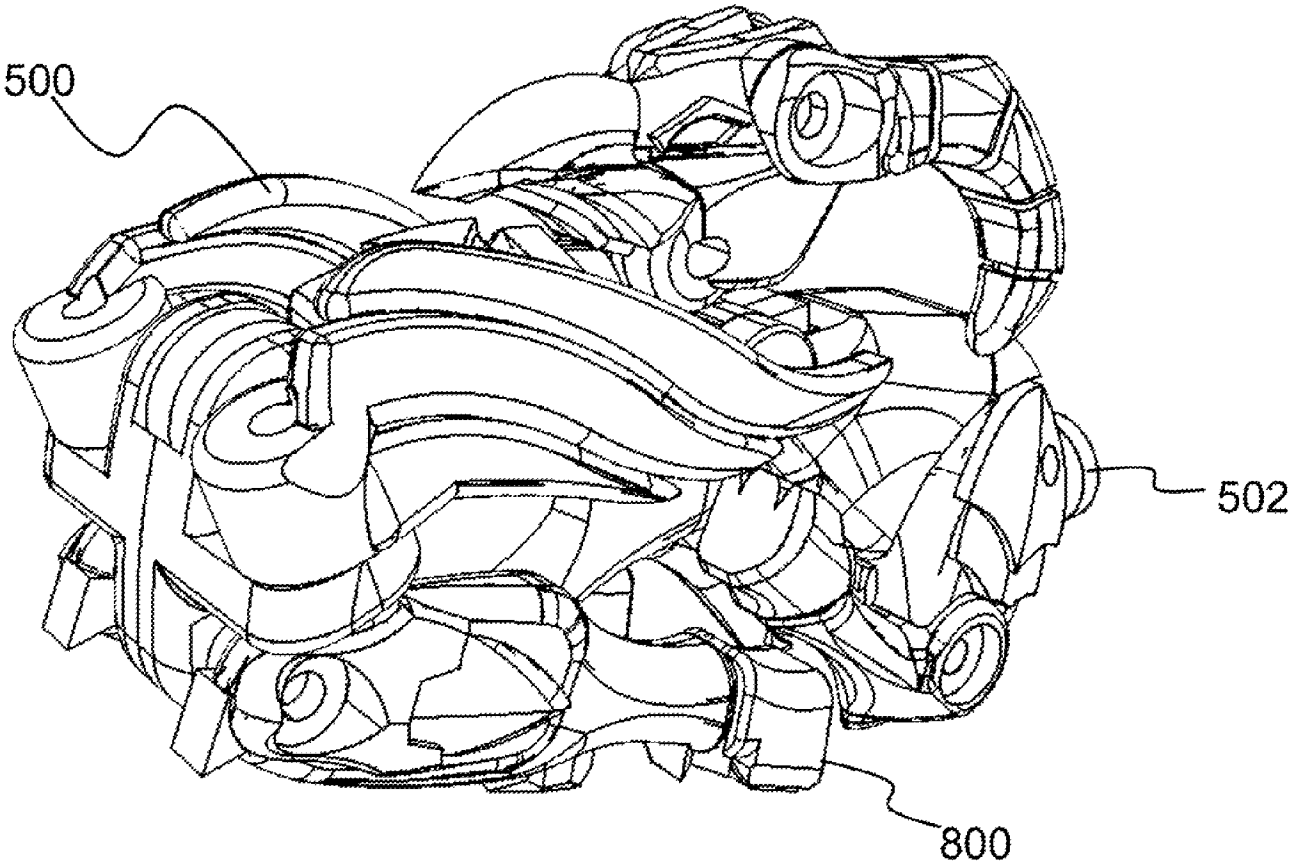
FIG. 8A is an illustration of a transforming object in a collapsed state that can be concealed within and expelled from a core according to the present invention.

For example, FIG. 8A depicts a specific example of an expandable object 500 that can be concealed within a core according to the present invention. As shown, the expandable object 500 is a creature that is in a closed or collapsed position. The collapsed position allows the object to be easily positioned within the cavity of a core. Also shown is a clasp 502. As noted above, the clasp 502 is used for connecting with a release trigger (shown as reference number 402 in FIGS. 4A through 5D) or a pair of clips (shown as reference numeral 702 in FIG. 7), or any other suitable connection or release device that can be implemented in a core. Thus, through use of the clasp 502, the object is held within a core.

Figure 8B:
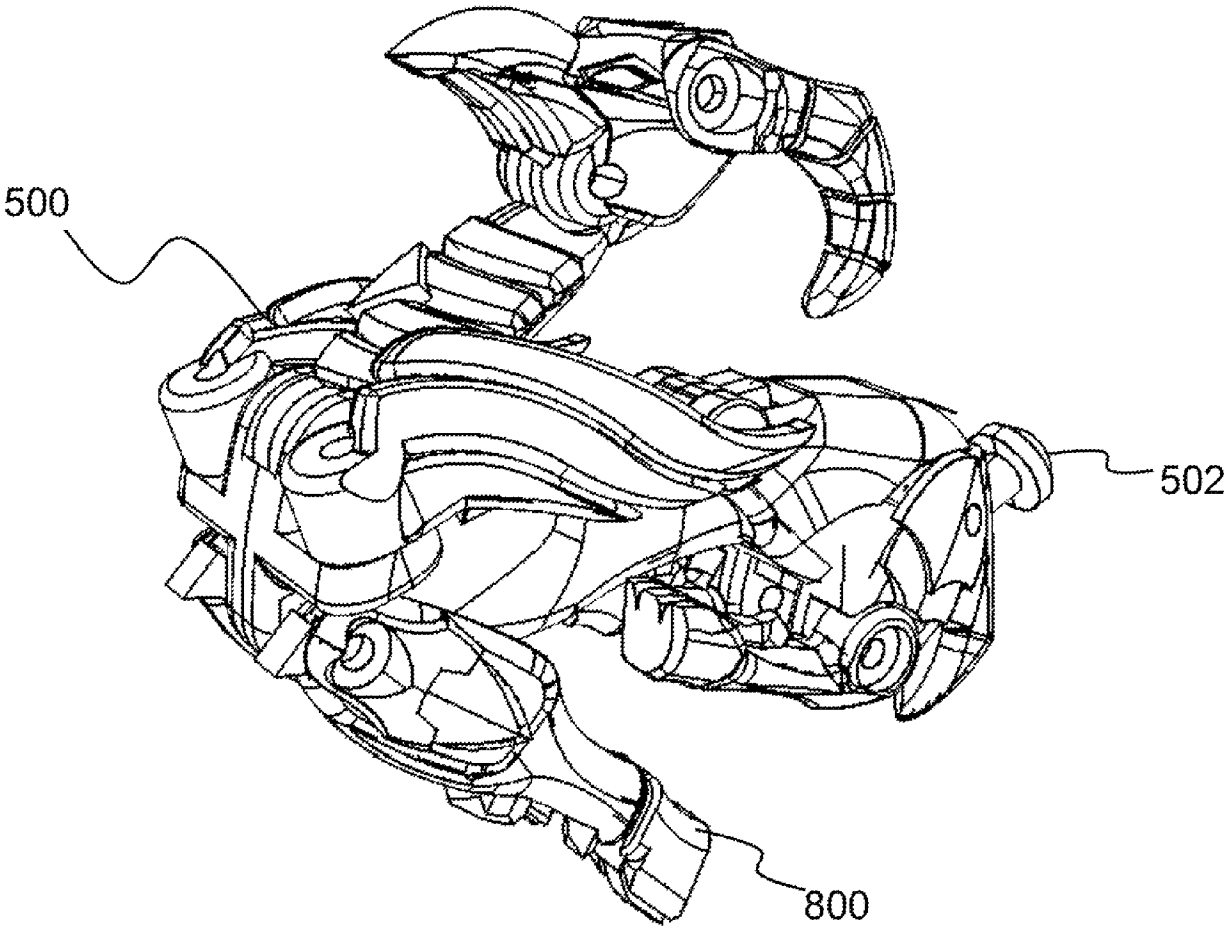
FIG. 8B is an illustration of the transforming object depicted in FIG. 8A, showing the object as expanding.
Figure 8C:
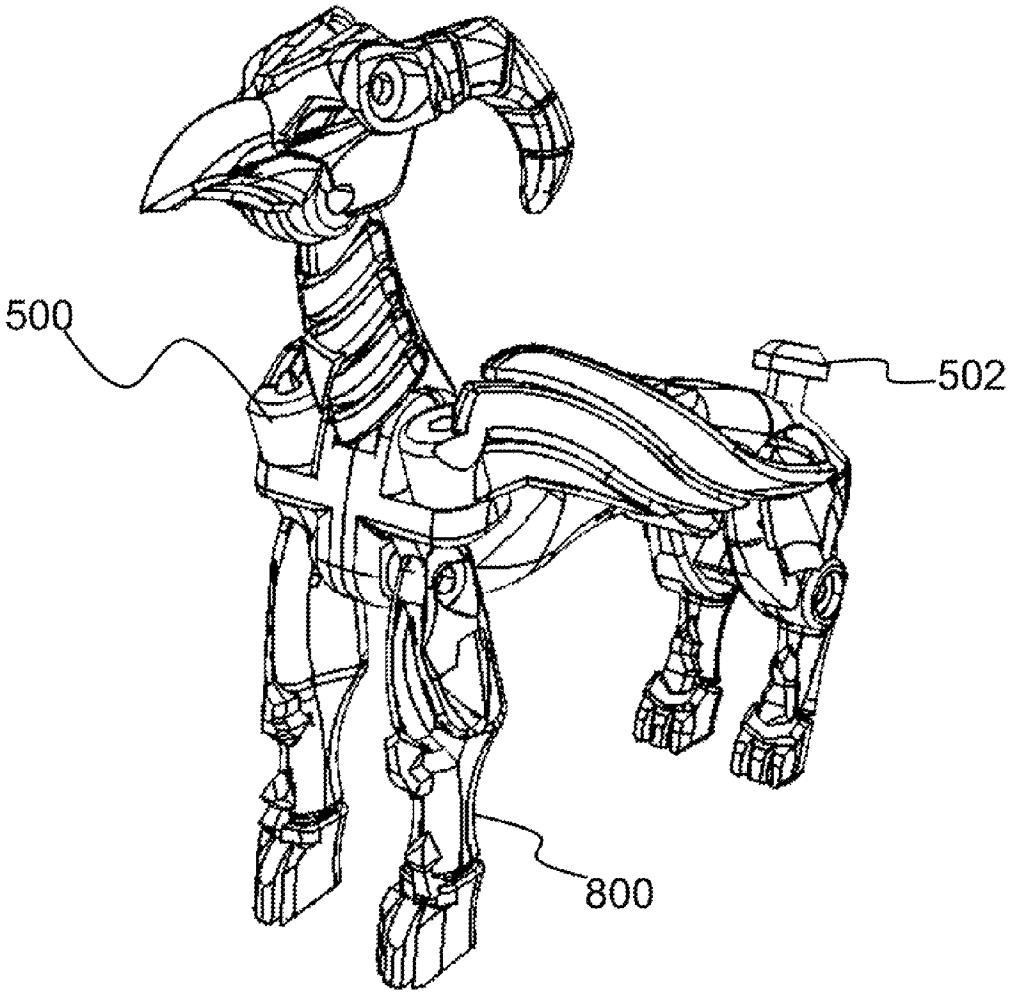
FIG. 8C is an illustration of the transforming object depicted in FIG. 8A, showing the object as expanded into its expanded state.
Figure 9A:
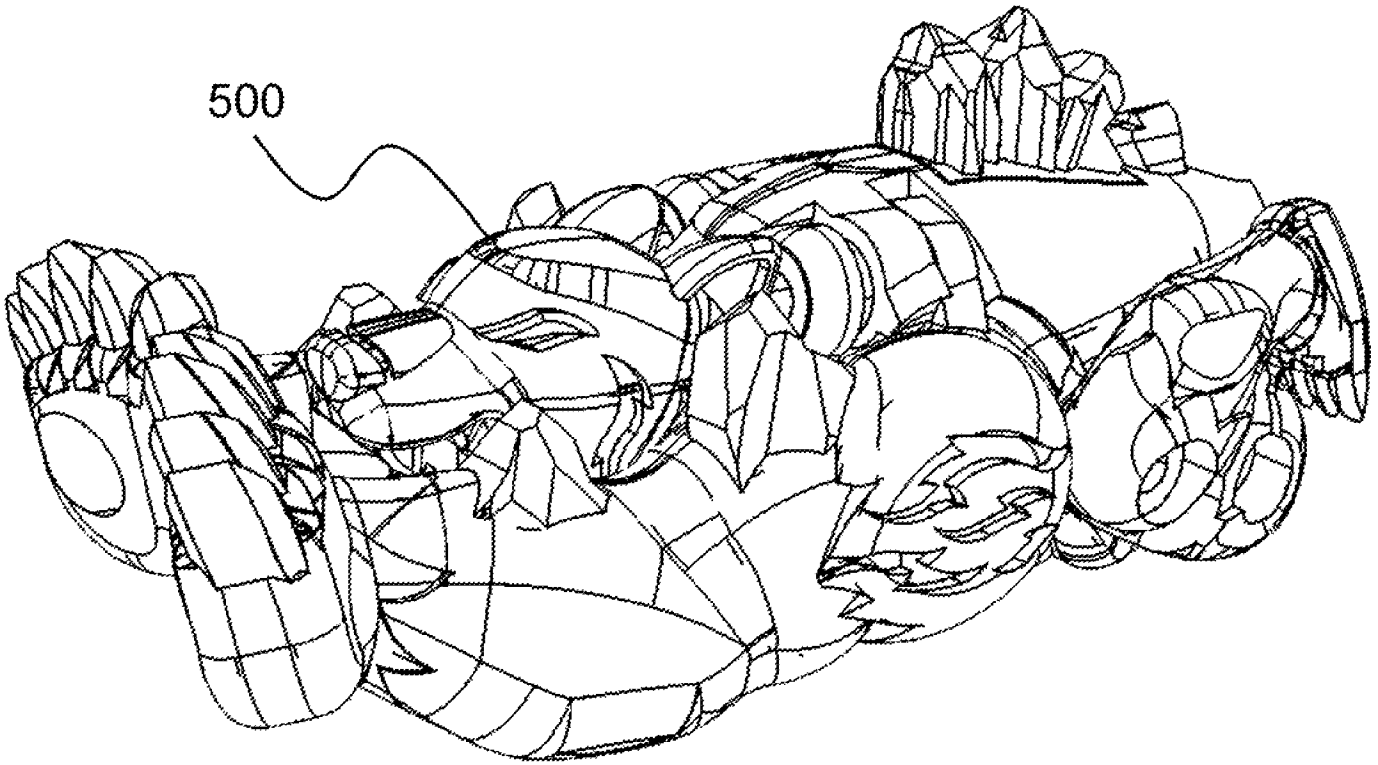
FIG. 9A is an illustration of a transforming object in a collapsed state that can be concealed within and expelled from a core according to the present invention.
Figure 9B:
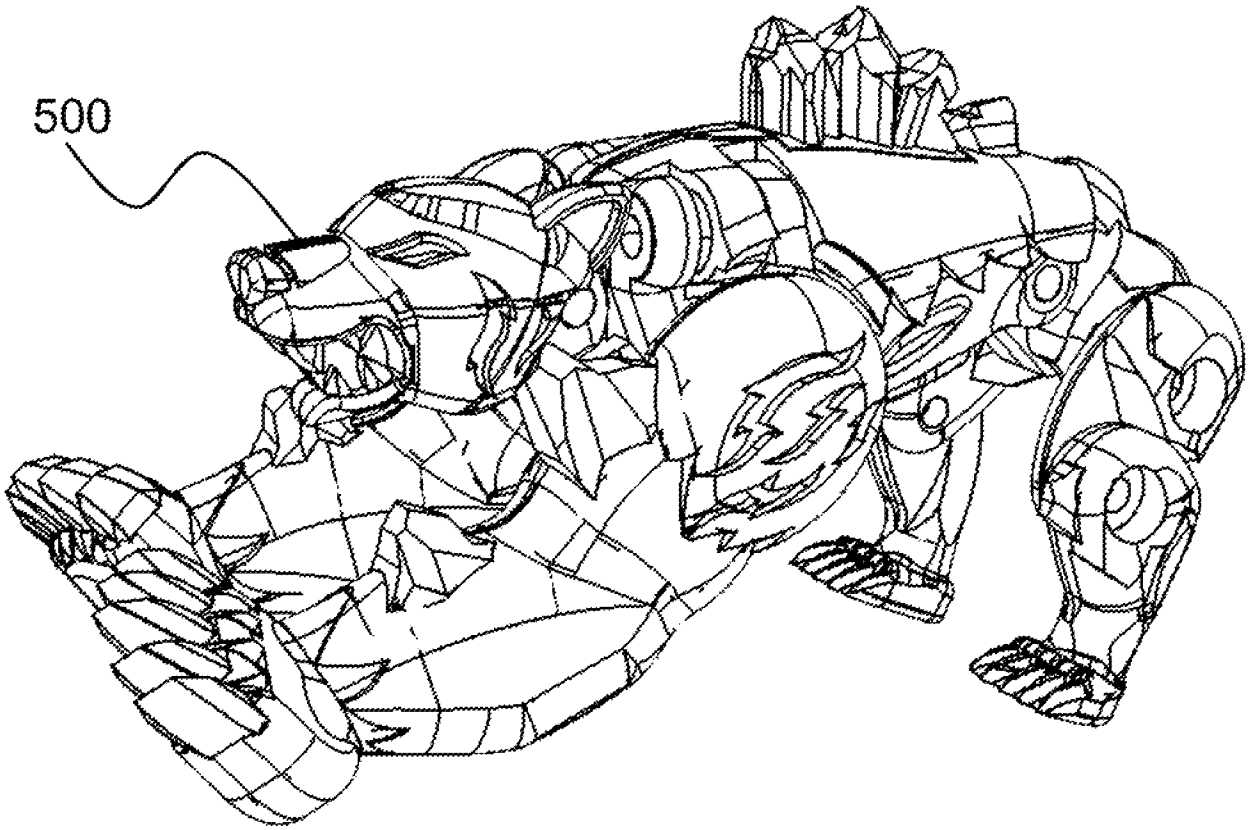
FIG. 9B is an illustration of the transforming object depicted in FIG. 9A, showing the object as expanding.
Figure 9C:
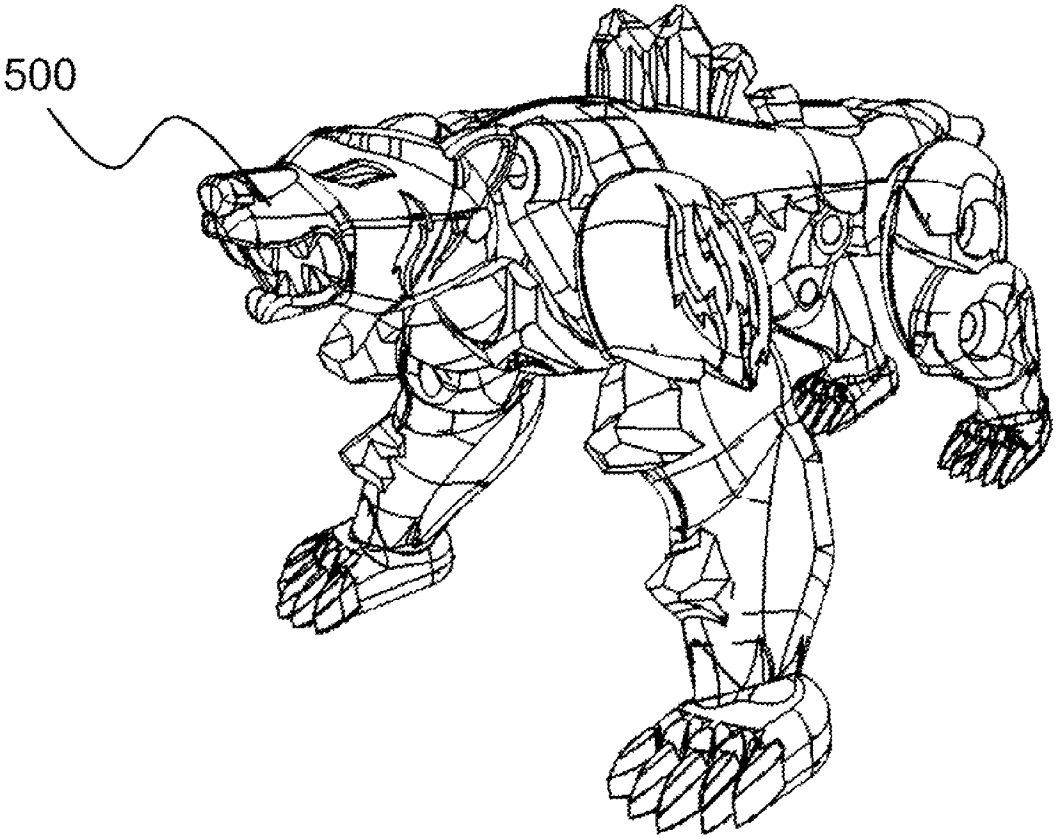
FIG. 9C is an illustration of the transforming object depicted in FIG. 9A, showing the object as expanded into its expanded state.
Figure 10A:
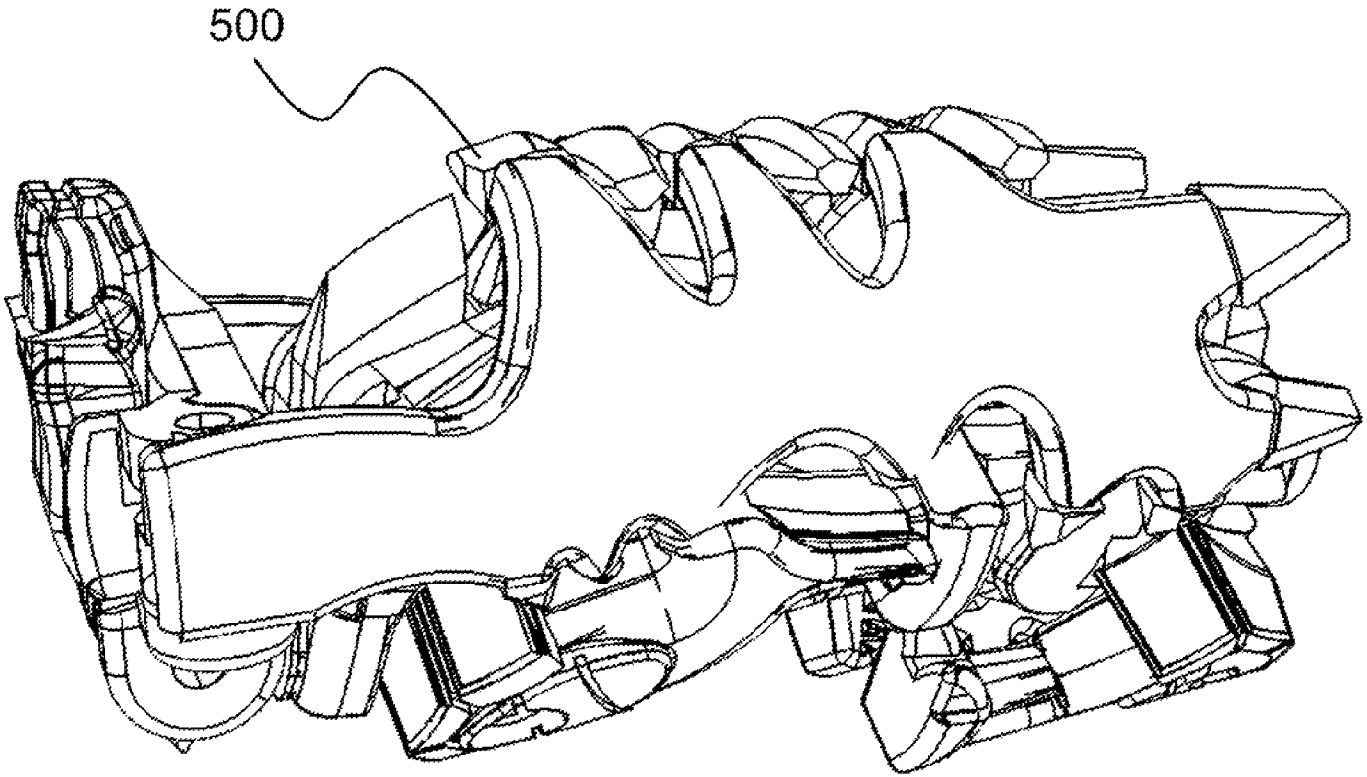
FIG. 10A is an illustration of a transforming object in a collapsed state that can be concealed within and expelled from a core according to the present invention.
Figure 10B:
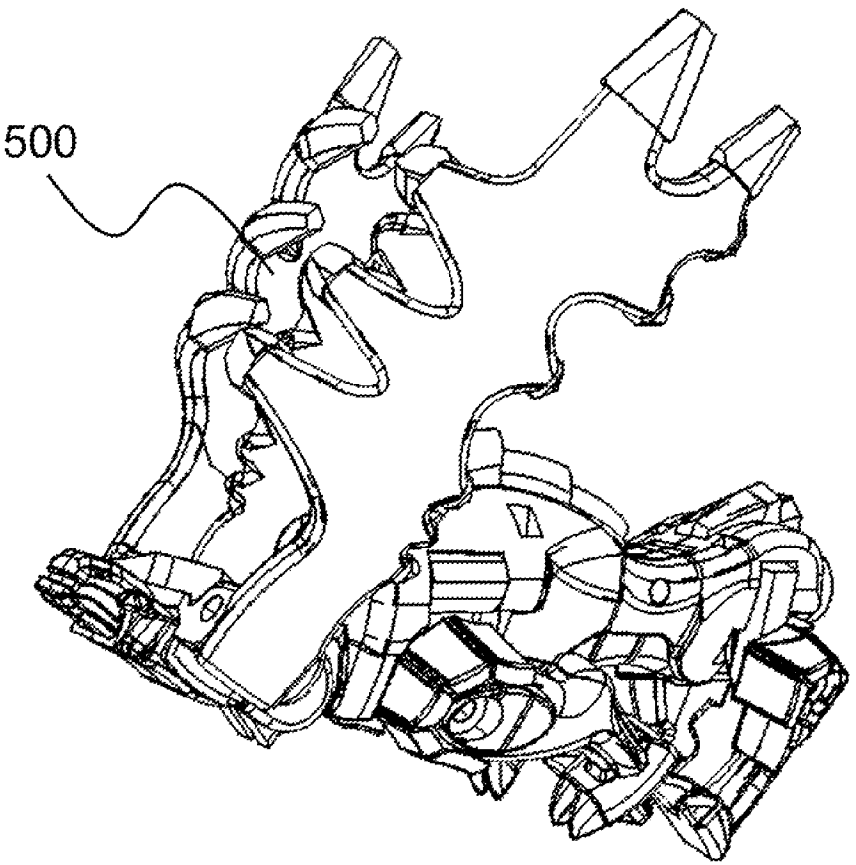
FIG. 10B is an illustration of the transforming object depicted in FIG. 10A, showing the object as expanding.
Figure 10C:
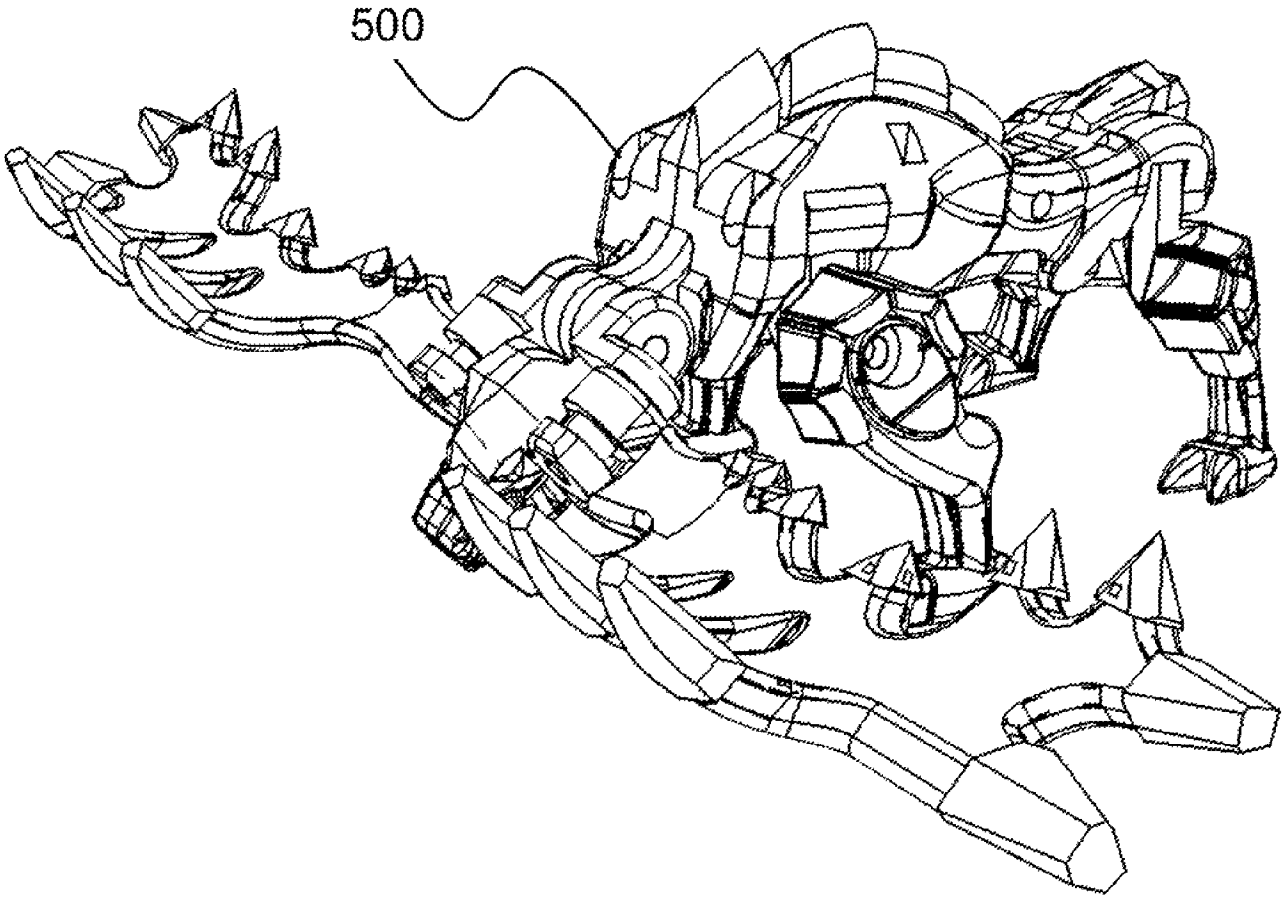
FIG. 10C is an illustration of the transforming object depicted in FIG. 10A, showing the object as expanded into its expanded state.

FIG. 8B depicts the object 500 expanding. Also shown is the clasp 502. Finally, FIG. 8C depicts the object 500 in its fully expanded form, which, in this example, is a horned creature. Again, the clasp 502 is depicted, which clearly illustrates how the object 500 can be maintained within a core.

As illustrated throughout FIGS. 8A through 8C, the object 500 includes various appendages 800 that were originally folded against the object 500 and that expand outward into the expanded form to form the final object. Each of the appendages 800 is pivotally attached and can swing outward. For example, in the case of the horned creature as depicted in FIG. 8C, the creature has legs, a head, horns, and wings, all of which are pivotally attached with another portion of the creature (such as a central body). The appendages 800 can be spring-loaded so that upon release from the core, the appendages 800 are forced outward into the expanded form. Alternatively, the appendages 800 can be simply pivotally attached so that they are manually rotated into their expanded form. In either event and as can be appreciated by one skilled in the art, the appendages 800 are collapsed in the collapsed state (as depicted in FIG. 8A) to allow the object 500 to be concealed within the core and can expand into the expanded state (as depicted in FIG. 8C) once released from the core.

For further illustration, FIGS. 9A through 10C depict two additional objects 500 as they expand from a collapsed state to an expanded state. As can be appreciated by one skilled in the art, the present invention can be applied to any transforming object that once released from the core, expands or unfolds to assume a new shape, such as a figure, monster, or character.

What is claimed is:

1. A rotatable core, comprising:

a housing having a length and a width, the length being longer than the width, the housing having an external portion and a cavity with an opening for receiving an object through the opening and into the cavity;

an indentation area formed in the external portion, and wherein the indentation area is formed off-center on the external portion of the housing and is formed to receive a user's finger and guide the user where to place their finger for launching, such that by pressing down on the indentation area, the core is forced against a ground surface, thereby causing the core itself to rotate on the ground surface around a vertical axis that passes through the width of the housing;

a release mechanism attached with the housing, the release mechanism including a connector for securely attaching with a corresponding connector on the object and an expelling mechanism for expelling the object entirely from the cavity, whereby upon activation of the release mechanism, the connector releases the object and the expelling mechanism forces the object entirely from the cavity such that the object is completely detached from the housing;

wherein the indentation area is formed with concavity and the housing is cylindrically-shaped;

wherein the connector of the release mechanism is a release trigger and the expelling mechanism is a spring-compressed platform, with the connector on the object being a clasp; and wherein the release mechanism further comprises a weighted pendulum that is operably connected with the release trigger, such that upon motion of the pendulum, the release trigger releases the clasp and, thereby, releases the object.

2. The rotatable core as set forth in claim 1, further comprising two raised rings running around a circumference of the core, wherein the core has two ends and the raised rings are circumferentially extending protrusions that extend around the circumference proximate both ends of the core.

3. The rotatable core as set forth in claim 2, further comprising an expandable object with a clasp for positioning within the cavity of the housing.

4. A rotatable core, comprising:

a housing having a length and a width, the length being longer than the width, the housing having an external portion and a cavity with an opening for receiving an object through the opening and into the cavity;

an indentation area formed in the external portion, and wherein the indentation area is formed off-center on the external portion of the housing and is formed to receive a user's finger and guide the user where to place their finger for launching, such that by pressing down on the indentation area, the core is forced against a ground surface, thereby causing the core itself to rotate on the ground surface around a vertical axis that passes through the width of the housing;

a release mechanism attached with the housing, the release mechanism including a connector for securely attaching with a corresponding connector on the object and an expelling mechanism for expelling the object entirely from the cavity, whereby upon activation of the release mechanism, the connector releases the object and the expelling mechanism forces the object entirely from the cavity such that the object is completely detached from the housing; and wherein the release mechanism includes a pendulum with a magnet for magnetically connecting with an object positioned within the cavity, such that upon impact of the core with a surface, the pendulum is swung away from the object to break the magnetic connection with the object and release the object from the housing.

5. The rotatable core as set forth in claim 4, further comprising an expandable object for positioning within the cavity of the housing, the expandable object being magnetically attracted to the pendulum with the magnet.

6. A rotatable core, comprising:

a housing, the housing having a cavity therein for receiving an object;

a release mechanism attached with the housing, the release mechanism including a connector for connecting with an object, whereby upon activation of the release mechanism, the connector releases the object from the housing; and wherein the release mechanism includes a pendulum, with the connector being a magnet attached with the pendulum for magnetically connecting with an object positioned within the cavity, such that upon impact of the core with a surface, the pendulum is swung away from the object to break the magnetic connection with the object and release the object from the housing.

7. The rotatable core as set forth in claim 6, further comprising an expandable object for positioning within the cavity of the housing, the expandable object being magnetically attracted to the pendulum with the magnet.

* * * * *